US009373916B2

(12) United States Patent
Liu

(10) Patent No.: US 9,373,916 B2
(45) Date of Patent: Jun. 21, 2016

(54) RECEPTACLE STRUCTURE

(71) Applicant: TRIPLE WIN PRECISION TECHNOLOGY CO., LTD., Taoyuan, Taoyuan County (TW)

(72) Inventor: Chih Pin Liu, Taoyuan (TW)

(73) Assignee: TRIPLE WIN PRECISION TECHNOLOGY CO., LTD., Taoyuan (TW)

( * ) Notice: Subject to any disclaimer, the term of this patent is extended or adjusted under 35 U.S.C. 154(b) by 0 days.

(21) Appl. No.: 14/554,227

(22) Filed: Nov. 26, 2014

(65) Prior Publication Data

US 2016/0149345 A1 May 26, 2016

(51) Int. Cl.

| | |
|---|---|
| ***H01R 13/648*** | (2006.01) |
| ***H01R 13/6581*** | (2011.01) |
| ***H01R 24/60*** | (2011.01) |
| *H01R 107/00* | (2006.01) |

(52) U.S. Cl.

CPC ..... *H01R 13/6581* (2013.01); *H01R 24/60* (2013.01); *H01R 2107/00* (2013.01)

(58) Field of Classification Search

CPC ..... H01R 13/6581; H01R 13/6596; H01R 13/6595; H01R 13/6461; H01R 13/6585; H01R 13/665; H01R 13/658; H01R 13/6592; H01R 13/6587; H01R 13/6593; H01R 13/504; H01R 24/60; H01R 2107/00

USPC ..... 439/607.01, 607.17, 607.19, 607.27, 439/607.28, 607.35, 607.36, 607.05, 439/607.41, 607.46, 607.51, 660

See application file for complete search history.

(56) References Cited

U.S. PATENT DOCUMENTS

| | | | | |
|---|---|---|---|---|
| 6,364,706 | B1 * | 4/2002 | Ando | H01R 23/6873 439/607.37 |
| 6,659,799 | B2 * | 12/2003 | Yang | H01R 4/028 439/607.01 |
| 7,744,382 | B2 * | 6/2010 | Zheng | H01R 13/65802 439/577 |
| 8,740,649 | B2 * | 6/2014 | Lan | H01R 13/506 439/607.4 |
| 8,790,138 | B2 * | 7/2014 | Wang | H01R 27/02 439/607.4 |
| 8,882,515 | B2 * | 11/2014 | Lv | H01R 13/6581 439/607.35 |
| 8,882,540 | B2 * | 11/2014 | Yen | H01R 27/00 439/489 |
| 8,974,249 | B2 * | 3/2015 | Zhang | H01R 12/724 439/607.4 |
| 2009/0258539 | A1 * | 10/2009 | Zheng | H01R 13/65802 439/607.41 |
| 2016/0064864 | A1 * | 3/2016 | Kao | H01R 13/6461 439/607.05 |

* cited by examiner

*Primary Examiner* — Neil Abrams
*Assistant Examiner* — Travis Chambers
(74) *Attorney, Agent, or Firm* — Rabin & Berdo, P.C.

(57) ABSTRACT

A receptacle structure, which is specifically referred to a joint assembly of terminal with plural signal pins, a main isolator and a metallic casing, wherein the terminal with plural pins is further separated with an upper row terminator and a lower row terminator, the metallic casing is extended with a fixing part at the back side and is configured with an upper rib and at least a spring on the top surface of fixing part, and both laterals are formed as side curvatures with each side opening. Thus, the present invention provides a better shielding protection against ESD—Electrostatic Discharge and enables a high frequency characteristic control which stabilizes the impedance variation within the error range.

9 Claims, 10 Drawing Sheets

RECEPTACLE STRUCTURE

BACKGROUND OF THE INVENTION

1. Field of the Invention

The present invention relates to an electrical receptacle structure and is especially applied in the newly specified receptacle structure of USB 3.1 Type C or similar receptacle structures.

2. Description of Prior Art

The USB (Universal Serial Bus) connectors had been widely adopted as a standard port to function as a transmission interface between the computer and external peripherals. Especially, USB connectors are popularly used in flash memory device and equipped with function of 'hot plugging' or 'plug and play'.

Following the trend to be lighter, thinner and smaller, there are several USB connectors' specification had been released and specified as standard of A type, B type, Mini USB and Micro USB. Under a global request for a unified type of electrical plug and receptacle, the USB promoter group starts a newly design and releases it as the specification of USB 3.1 type C to be wide adopted in various electronic and information products.

One of the primary specification adopted in USB 3.1 type C is to control its impedance variation within the standard of 8552±9Ω while the signal is transmitted at high speed along the signal terminal. Most products could be manufactured to comply with the new USB 3.1 type C impedance standard. However, the terminal with plural pins tends to interfere signal transmission due to the interior structure design. And, under such a circumstance, the stability of signal transmission is worsened and it reduces the function and meaning of newly released high speed USB plug and receptacle.

In view of the above discussed problems, the present invention aims to provide a better structural assembly to get rid of technical defect and maintain the efficiency of data transmission at high speed. Therefore, the prior USB connectors need to be improved.

SUMMARY OF THE INVENTION

The primary object of the present invention is to provide a design of receptacle structure, which is specifically referred to a joint assembly of terminal with plural signal pins, a main isolator and a metallic casing, wherein the terminal with plural pins is further separated with a upper row terminator and a lower row terminator; the main isolator is composed of an upper isolator and a lower isolator; the said terminal with plural signal pins are configured inside the main isolator; the metallic casing, wrapping around the main isolator, is extended as a fixing part at the back side and is configured with an upper rib and at least a spring on top of its surface; and both laterals are formed as side curvatures with each side opening. Thus, the present invention provides a better shielding protection against ESD (Electrostatic Discharge) and enables a high frequency characteristic control which stabilizes the impedance variation within the error range.

Another object of the present invention is to provide a receptacle structure, wherein the plural signal pins of upper row terminator are bent upward to form as a contact part at the front, and are bent downward at the after-part and extended backward as a soldering end; the plural signal pins of lower row terminator are bent downward at the front to form as a contact part, and are bent upward at the after-part and further extended backward by a distance of 0.25 cm and then bent downward to form as a soldering end; and the impedance could be controlled within the range of 85Ω±3.5Ω which is a better and stable electrical characteristic than that of present specification 85Ω±9Ω recommended by USB promoter group.

And, one more object of the present invention is to provide a receptacle structure, wherein the fixing part extended at the back side of metallic casing is configured on the base and the first embodiment of the said base is configured with plural contact pads and an insertion slot at each side, both sides at the fixing part are bent downward and extended as a side insert arm to fit into the insertion slots on the base, and both plural signal pins of upper and lower row terminators are passing through the back of metallic case to be soldered with those contact pads on the base. Besides, the second embodiment of the said base is configured with plural contact pads and a side mount pad at each side, both sides at the fixing part are bent downward and then bent again toward the outside to be extended as a side mount pad and soldered on the base, and also both plural signal pins of upper and lower row terminators are passing through the back of metallic case to be soldered with those contact pads on the base. Both embodiments enable the present invention to be applied in either SMT (Surface-Mount Technology) or DIP (Dual In-line Package) manufacturing process.

In short, the present invention—a receptacle structure, is primarily comprising a joint assembly of terminal with plural signal pins, a main isolator and a metallic casing, wherein the terminal with plural pins is further separated with an upper row terminator and a lower row terminator; the main isolator is composed of an upper isolator and a lower isolator; the said terminal with plural signal pins are configured inside the main isolator; the metallic casing, wrapping around the main isolator, is extended as a fixing part at the back side and configured with an upper rib and at least a spring on top of its surface; and both laterals are formed as side curvatures with each side opening.

The function and structure of practical embodiments can be further understood via the following brief description of the drawings and elements listed below.

BRIEF DESCRIPTION OF THE DRAWINGS AND ELEMENTS

The present invention can be fully understood from the following detailed description and preferred embodiment with reference to the accompanying drawings, in which.

The elements related to the present invention are listed as follows:

| | |
|---|---|
| 1, terminal | 2, main isolator |
| 3, metallic casing | 11, upper row terminator |
| 12, lower row terminator | 21, upper isolator |
| 22, lower isolator | 23, rabbet |
| 24, fixing plate | 25, cover |
| 31, spring | 32, fixing part |
| 33, side curvature | 34, side opening |
| 40, H-shape isolator | 41, hook |
| 42, notch | 50, metallic housing |
| 51, insertion port | 52, upper fitting |
| 53, strip opening | 60, base |
| 61, contact pad | 62, insertion slot |
| 63, side mount pad | |
| 111, fore-part | 112, contact part |
| 113, mid-part | 114, after-part |
| 115, soldering end | 121, fore-part |
| 122, contact part | 123, mid-part |
| 124, after-part | 125, extension part |
| 126, soldering end | |
| 211, coupling part | 212, notch |
| 213, opening | 214, stopper |
| 221, protruding rib | 222, notch |
| 223, opening | 224, stopper |
| 241, vertical rib | 242, pin space |
| 321, upper rib | 322, side insert arm |
| 323, side mount arm | |

DETAILED DESCRIPTION OF THE PREFERRED EMBODIMENTS

Please refer to FIG. 1 to FIG. 10 which respectively illustrates those schematic views referring to a receptacle structure and is specifically applied in a structure of USB 3.1 type C. And, it is able to be applied in a SMT or DIP manufacturing process.

Figure 3:
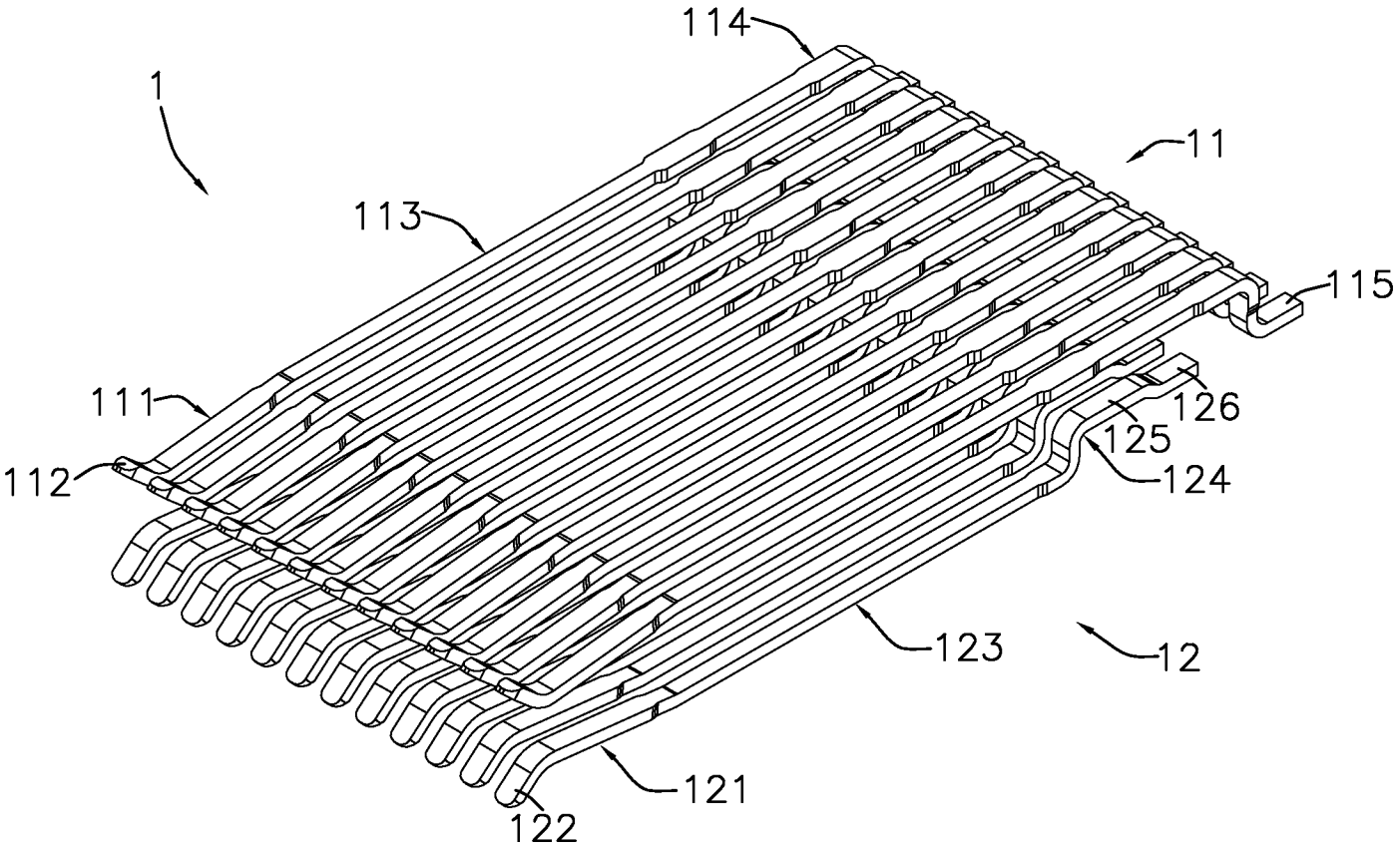
FIG. 3 illustrates a schematic three-dimensional view of the signal terminal.

The present invention primarily comprises a joint assembly of terminal 1 with plural signal pins, a main isolator 2 and a metallic casing 3, wherein the terminal 1 with plural pins, configured inside the main isolator 2, is further separated with a upper row terminator 11 and a lower row terminator 12 which respectively contains twelve (12) signal pins (as shown in FIG. 3); the plural signal pins of upper row terminator 11 are bent upward at the fore-part 111 to form as a contact part 112, extends backward a section of mid-part 113, and then are bent downward at the after-part 114 and extended backward as a soldering end 115. Meanwhile, both pin width of fore-part 111 and after-part 114 in the upper row terminator 11 are wider than that of mid-part 113. And, the plural signal pins of lower row terminator 12 are bent downward at the fore-part 121 to form as a contact part 122, extends backward a section of mid-part 123, and are bent upward at the after-part 124 and further extended backward as extension part 125 by a distance of 0.25 cm and then bent downward to form as a soldering end 126. Furthermore, the pin width of extension part 125 is wider than that of mid-part 123.

Figure 4:
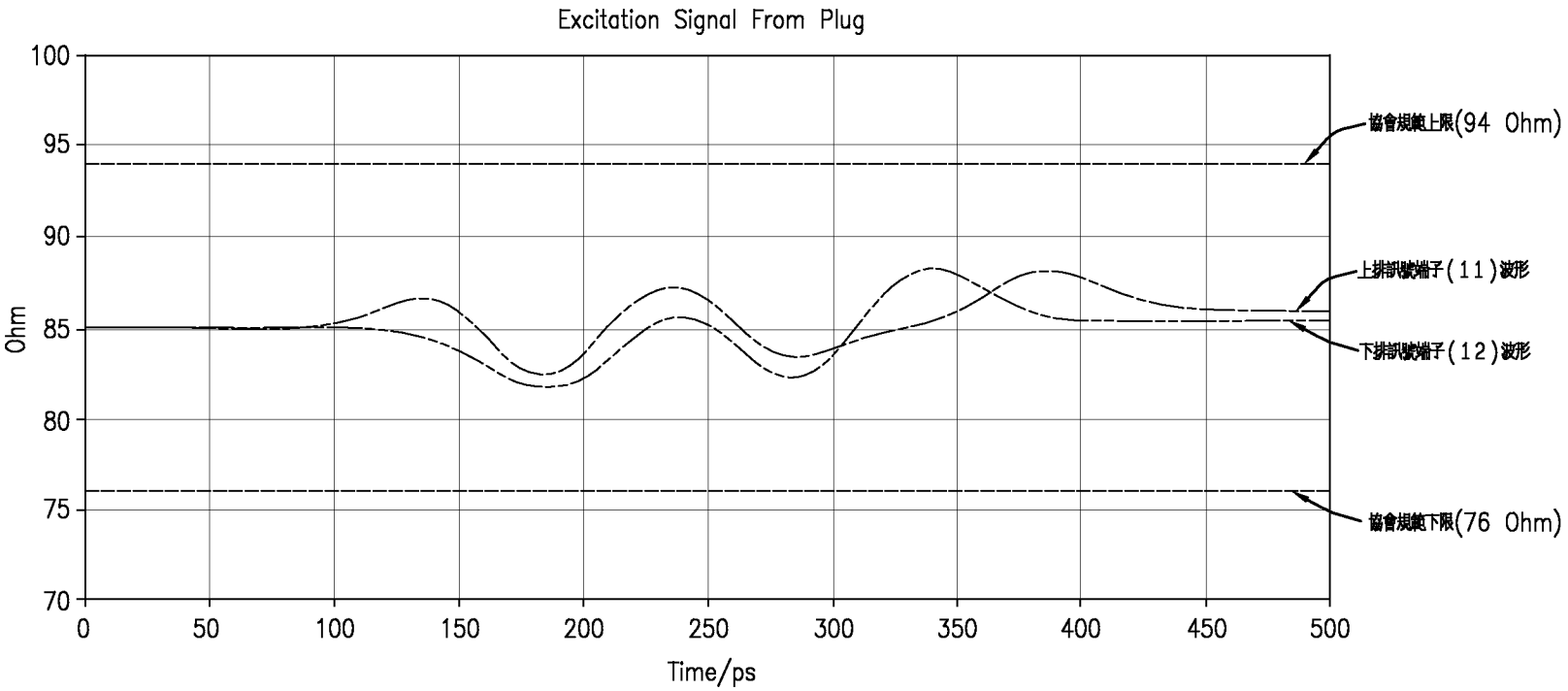
FIG. 4 illustrates a schematic impedance waveform related to the signal terminal. (upper impedance limit; waveform of upper row terminal; waveform of lower row terminal; lower impedance limit)

By such a joint assembly of contact parts 112, 122 from both upper row terminator 11 and a lower row terminator 12, the present invention provides an electrical connection with the plug from the other side (not shown) and enables the impedance variation of upper row terminator 11 and a lower row terminator 12 could be controlled within the range of 85Ω±3.5Ω (as shown in FIG. 4) which is a better and stable electrical characteristic than that of present specification 85Ω±9Ω recommended by USB promoter group.

Figure 1:
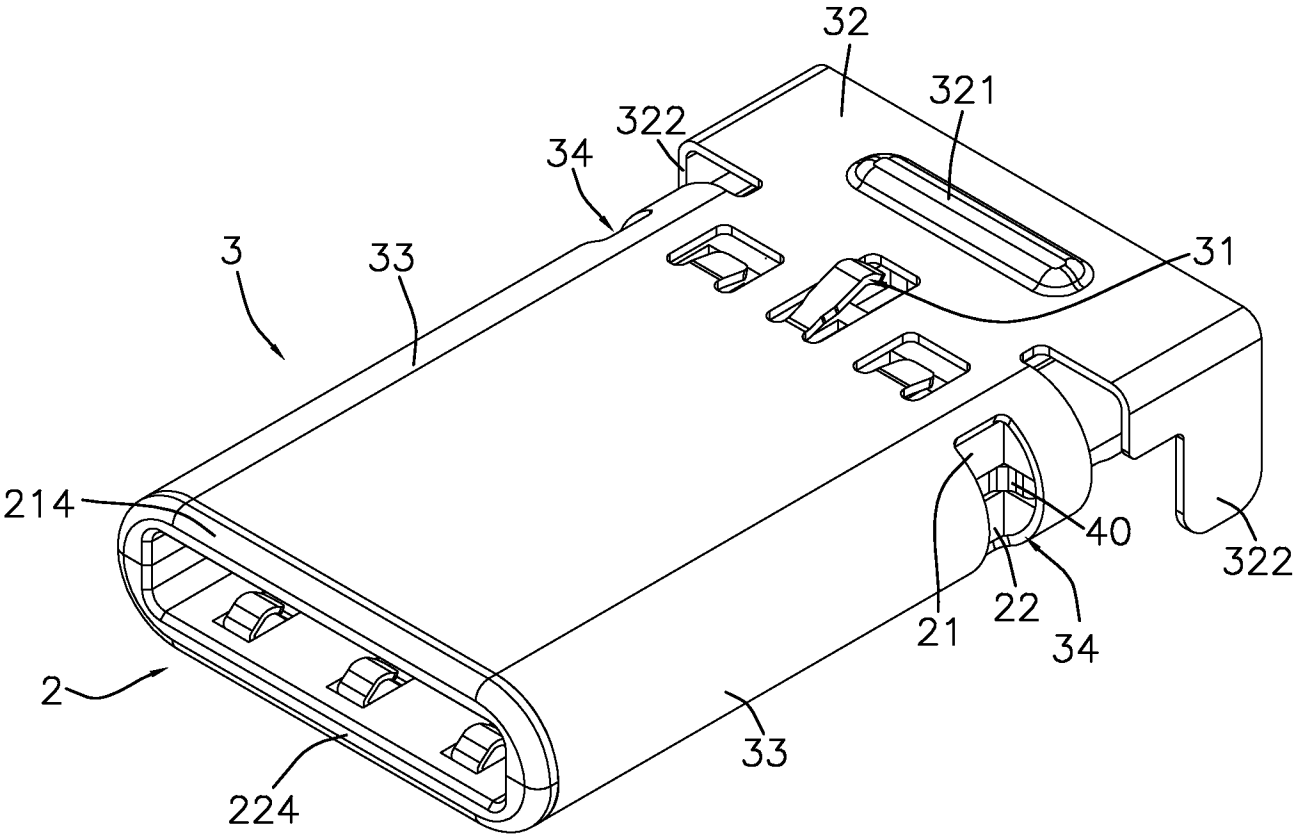
FIG. 1 illustrates a three-dimensional appearance of the present invention.
Figure 2:
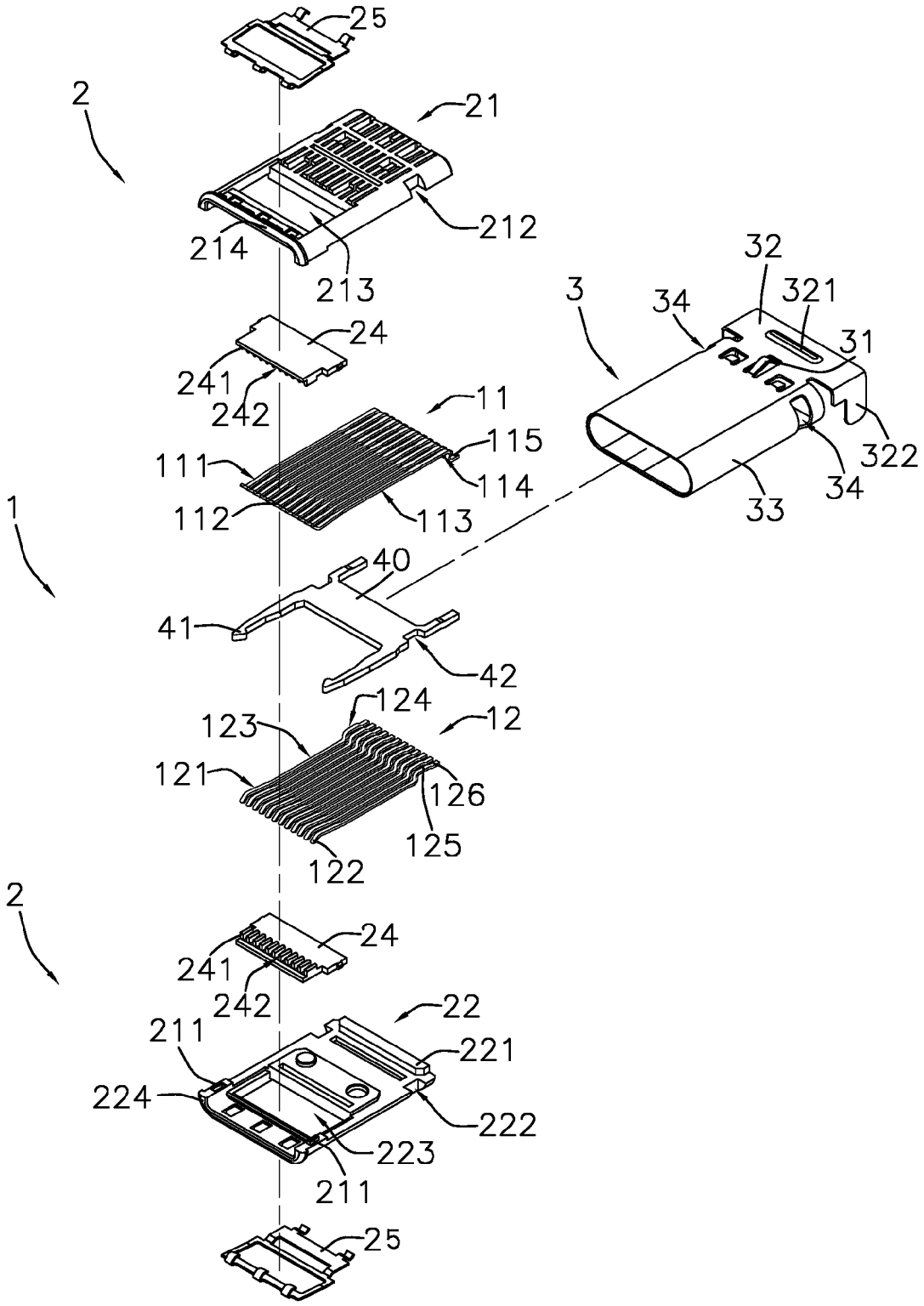
FIG. 2 illustrates a three-dimensional element decomposition view of the present invention.
Figure 5:
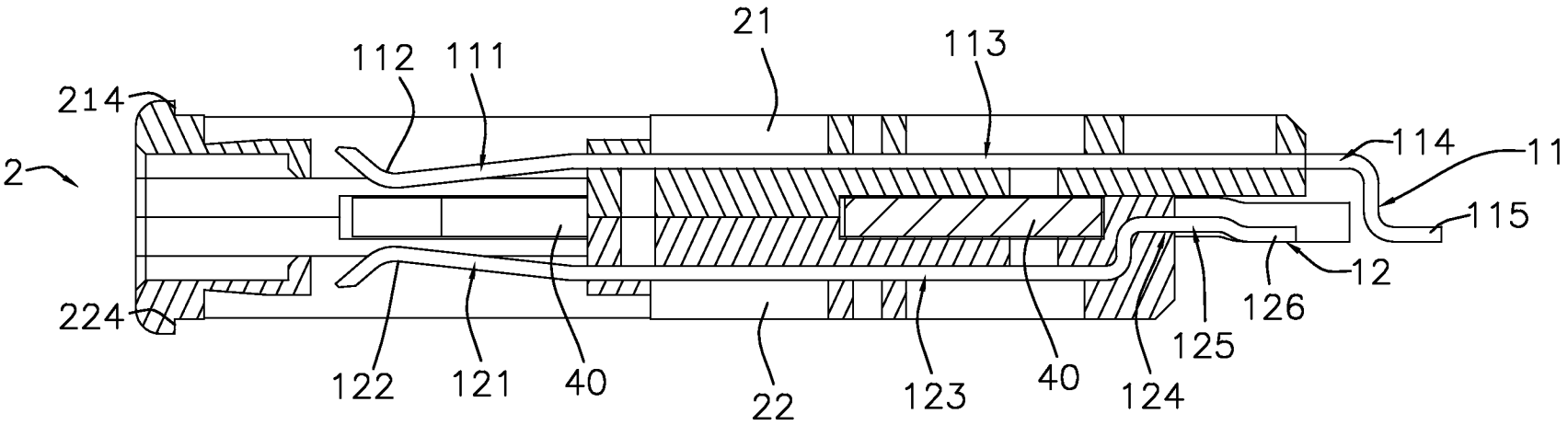
FIG. 5 illustrates a sectional assembly view of main isolator and signal terminal.
Figure 7:
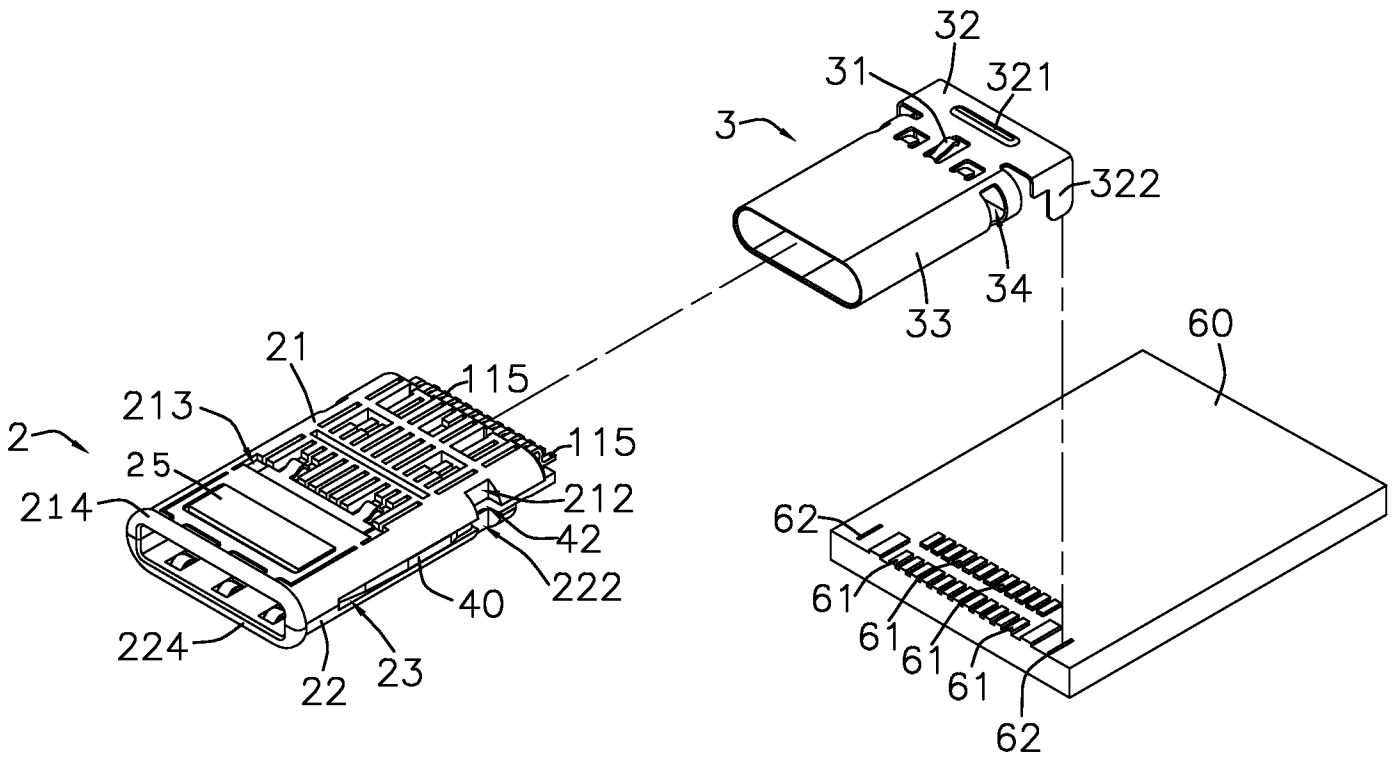
FIG. 7 illustrates a schematic decomposition view of metallic casing, main isolator and base related to the first embodiment.

And, the main isolator 2 is composed of an upper isolator 21 and a lower isolator 22 (as shown in FIG. 2 and FIG. 5), wherein both upper isolator 21 and lower isolator 22 are configured with plural of coupling parts 211 to fit each other reciprocally, both upper isolator 21 and lower isolator 22 are configured with notches 212, 222, and both side frame in the middle and after position are lower than that in the front to form as a rabbet 23 (as shown in FIG. 7).

And, both upper isolator 21 and lower isolator 22 are configured with a reciprocal opening 213, 223 which are fit with a cover 25 respectively (as shown in FIG. 2) to enhance its structure protection, and are embedded with a fixing plate 24 respectively (as shown in FIG. 2) which extends to form as plural vertical ribs 241 and pin space 242, and provides a secure position and accommodation for plural signal pins of both upper row terminator 11 and lower row terminator 12.

Furthermore, there is an H-shape isolator 40 configured between plural signal pins of upper row terminator 11 and lower row terminator 12, wherein the hook 41 is extended at each side of said H-shape isolator 40 and each notch 42 is configured at the middle position to have a structure assembly with those notches 212, 222 configured at both sides of upper isolator 21 and lower isolator 22. The hook 41 extended at each side of said H-shape isolator 40 are exposed externally and embedded into the rabbet located in the middle and after position of both sides of upper isolator 21 and lower isolator 22 to fix the H-shape isolator 40 and separate upper row terminator 11 and lower row terminator 12 safely.

Figure 6:
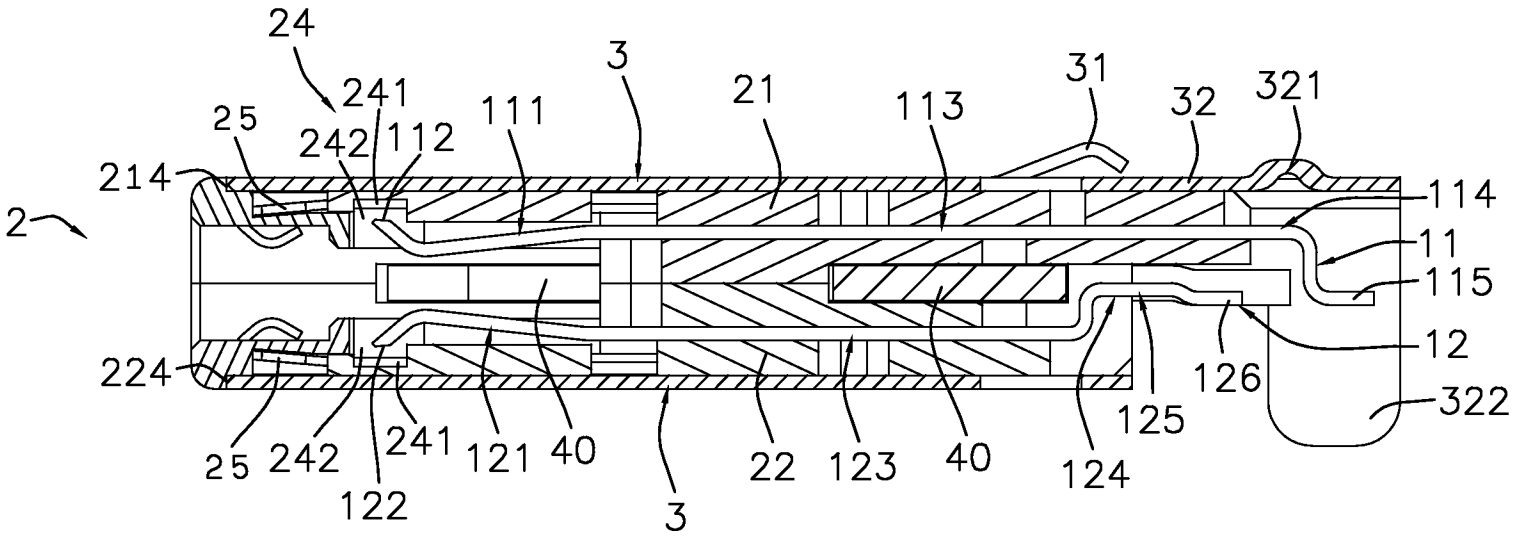
FIG. 6 illustrates a sectional assembly view of metallic casing, main isolator and signal terminal.

Besides, the main isolator 2, wrapped by the metallic casing 3, is composed of upper isolator 21 and lower isolator 22, which are formed as a stopper 214, 224 at both front to provide a solid assembly while the main isolator 2 is assembled within the metallic casing 3 and to prevent any slip therefrom (as shown in FIG. 6). And, the metallic casing 3 is extended as a fixing part 32 at the back side, and is configured with an upper rib 321 and at least a spring 31 on top of its surface, wherein the upper rib 321 is formed as a body of rectangle-oval or else (not shown) and both laterals are formed as side curvatures 33 with each side opening 34 to couple both notches 212, 222 configured at both sides of upper isolator 21 and lower isolator 22, and have a better solid assembly for the main isolator 2. Thus, it enables a convenient manufacturing process to insert a plastic material for fixing the combined structure, and provides a better shielding protection against ESD (Electrostatic Discharge) and an electrical characteristic control related to the stability during high speed signal transmission.

Figure 8:
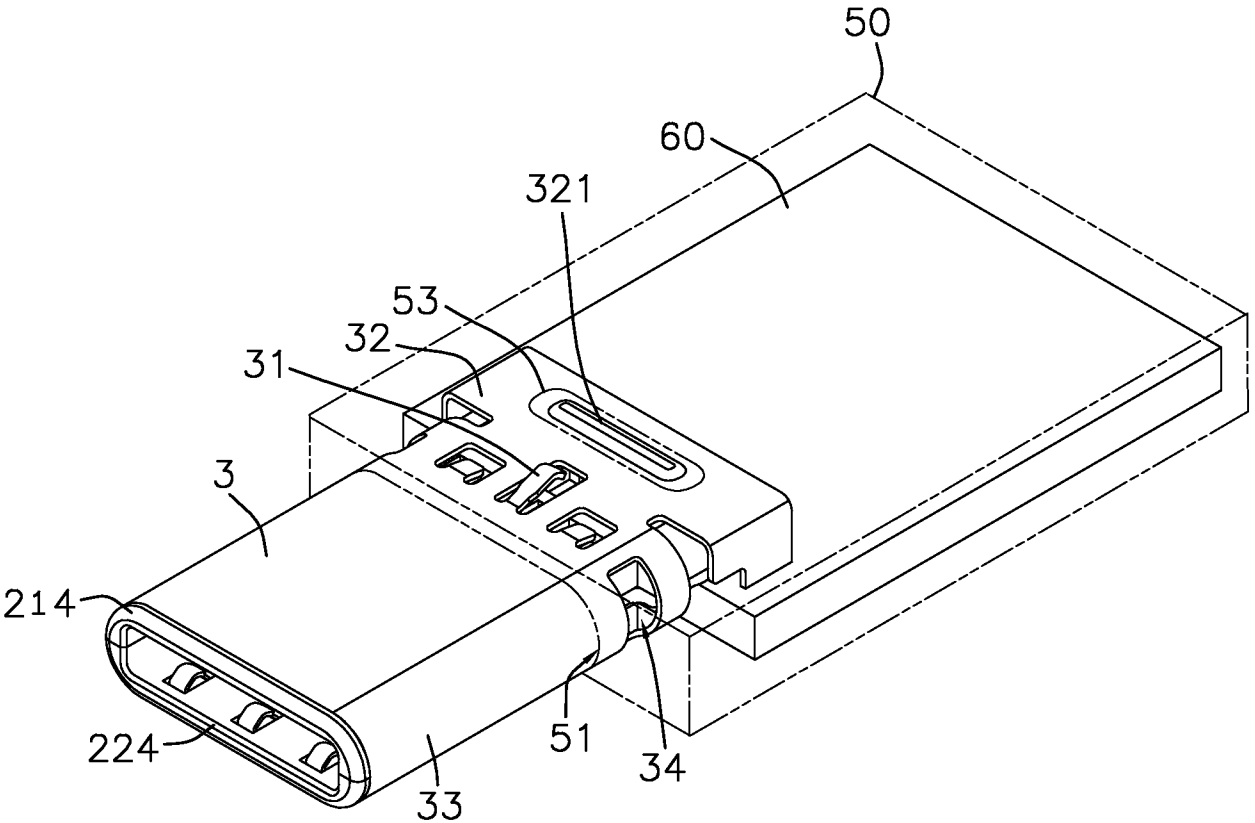
FIG. 8 illustrates a schematic assembly view of metallic casing, main isolator and base related to the first embodiment.
Figure 10:
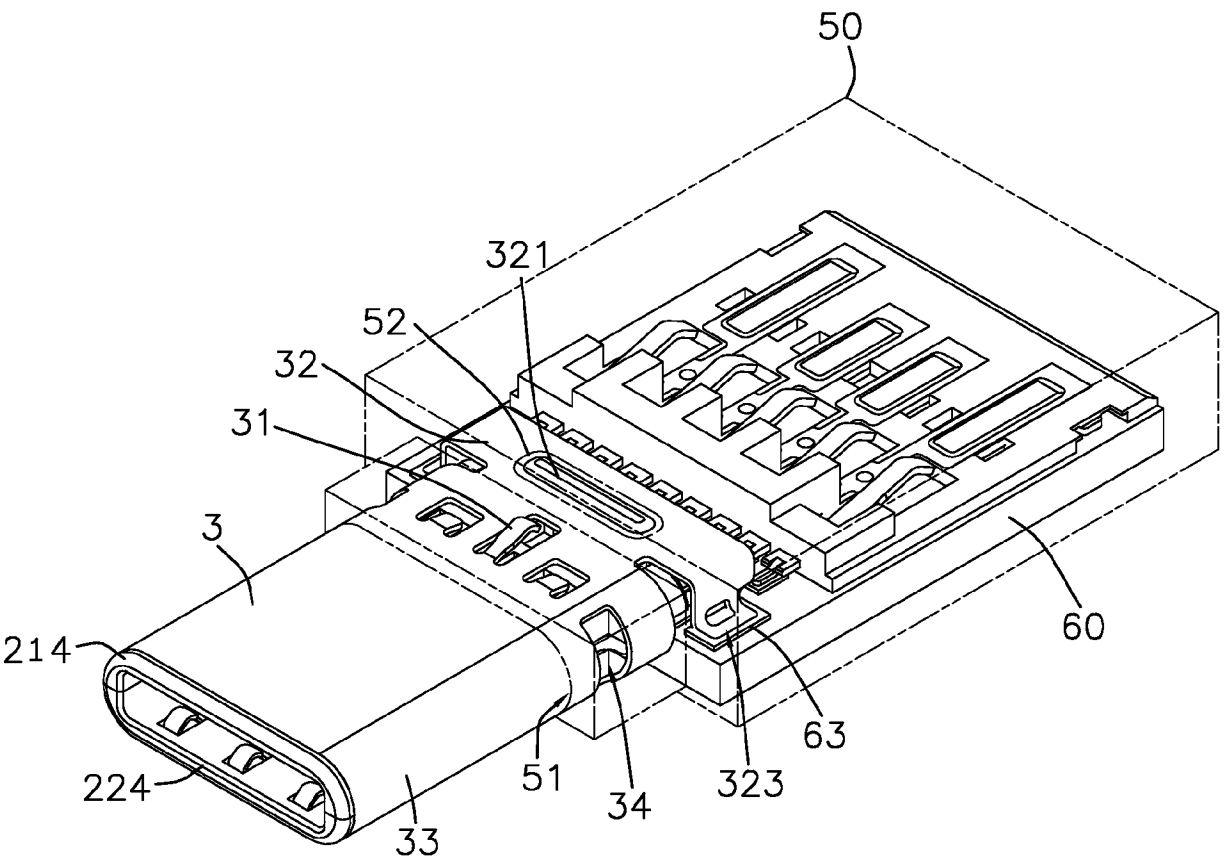
FIG. 10 illustrates a schematic assembly view of metallic casing, main isolator and base related to the second embodiment.

Also, the metallic casing 3 is able to be assembled with a metallic housing 50 (as shown in FIG. 8) which is configured with an insertion port 51 to fit the outer rim of said metallic casing 3 for connection. The metallic housing 50 is configured with an upper fitting 52 (as shown in FIG. 10) to have a solid joint assembly with the upper rib 321 located in the extended fixing part 32 and prevent the metallic housing 50 from any structure loose. Therefore, the upper rib 321 not only has a rigid assembly with the metallic housing 50, but also provides an ESD protection and keeps the integrity of the base 60. The metallic housing 50 could be configured with a strip opening 53 (as shown in FIG. 8) to expose and fit with the upper rib 321 located in the extended fixing part 32. This joint assembly provides another fixing function and a convenient trouble shooting for pressing the upper rib 321 to release it from tight combination with the metallic housing 50.

The at least one spring 31, extended on top surface of metallic casing 3, is configured to contact with the inner surface of metallic housing 50, and this structural characteristic enhance the ESD protection and protect the present invention from any damage from static electricity.

As the fixing part 32 extended at the back side of metallic casing 3 is assembled on the base 60, the first embodiment, applied in DIP (Dual In-line Package) manufacturing process, is configured with plural contact pads 61 and an insertion slot 62 at each side (as shown in FIG. 7 and FIG. 8) of the said base 60, both sides at the fixing part 32 are bent downward and extended as a side insert arm 322 to be fit and soldered into the insertion slots 62 on the base 60, and both plural signal pins of upper and lower row terminators 11, 12 are passing through the back lower of metallic case 3 to be soldered with those contact pads 61 on the base 60.

Figure 9:
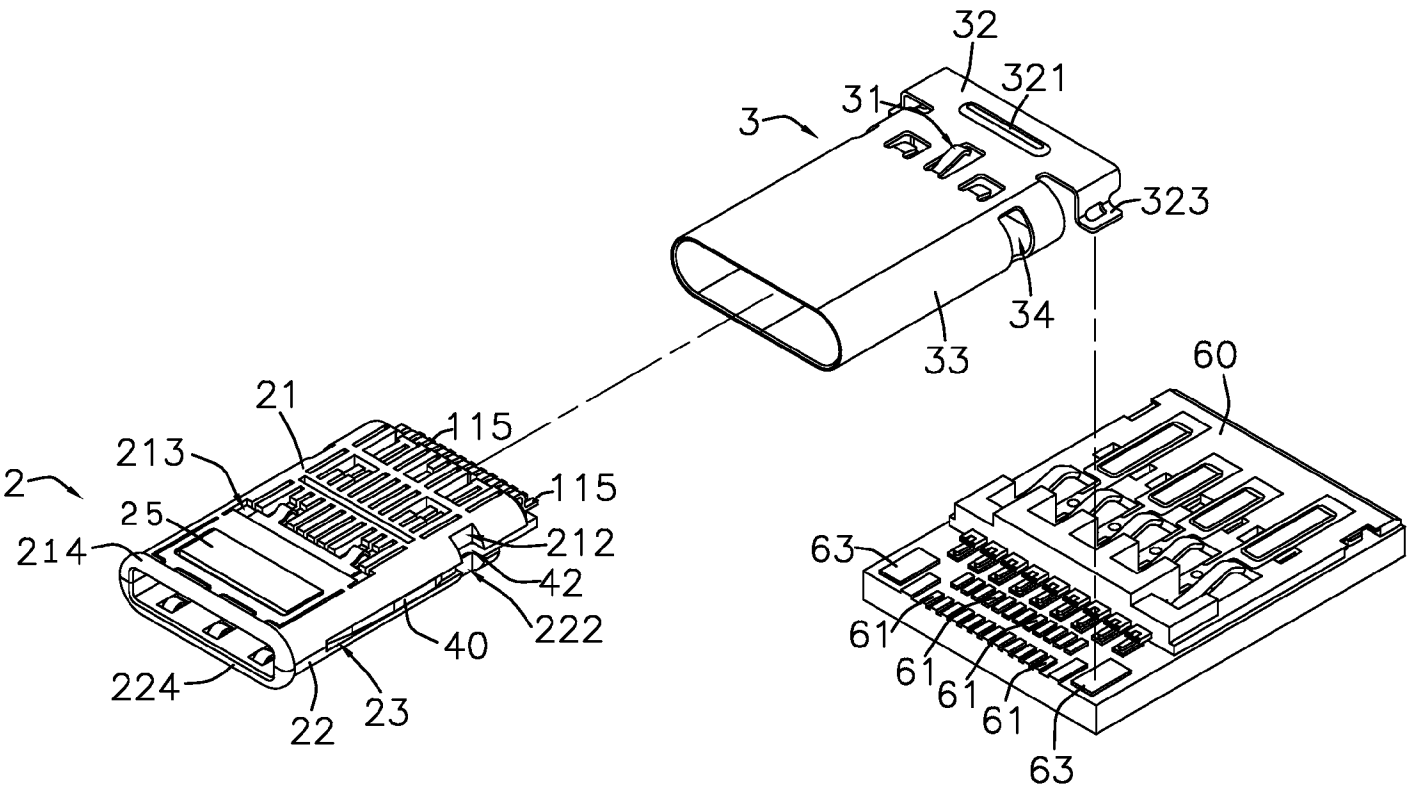
FIG. 9 illustrates a schematic decomposition view of metallic casing, main isolator and base related to the second embodiment.

Besides, the second embodiment, applied in SMT (Surface-Mount Technology) manufacturing process, is configured with plural contact pads 61 and a side mount pad 63 at each side (as shown in FIG. 9 and FIG. 10) of the said base 60, both sides at the fixing part 32 are bent downward and then bent again toward the outside to be extended as a side mount pad 323 and soldered on the side mount pad 63 of base 60, and also both plural signal pins of upper and lower row terminators 11, 12 are passing through the back lower of metallic case 3 to be soldered with those contact pads 61 on the base 60. Both embodiments enable the present invention to be applied in either SMT or DIP manufacturing process.

From the above detailed description, the present invention provides a disclosure and it enables the person skilled in this field is able to understand and complete the skill characteristic. Of course, it is to be understood that the embodiments described herein are merely some illustrations related to the objects of the invention and that a wide variety of modifications thereto may be adopted without departing from the purpose and the scope of the present invention as set forth in the following claims.

What is claimed is:

1. A receptacle structure, comprising:

a terminal with plural signal pins, which is further separated with a upper row terminator and a lower row terminator;

a main isolator, which is composed of an upper isolator and a lower isolator, and the said terminal with plural signal pins are configured within the main isolator;

a metallic casing, wrapping around the main isolator, is extended as a fixing part at the back side and is configured with an upper rib and at least a spring on top of its surface; and both laterals are formed as side curvatures with each side opening; and wherein the plural signal pins of upper row terminator are bent upward at the fore-part to form as a contact part, extends backward a section of mid-part, and then are bent downward at the after-part and extended backward as a soldering end; the plural signal pins of lower row terminator are bent downward at the fore-part to form as a contact part, extends backward a section of mid-part, and are bent upward at the after-part and further extended backward as extension part by a distance of 0.25 cm and then bent downward to form as a soldering end.

2. A receptacle structure according to claim 1, wherein there is an H-shape isolator configured between plural signal pins of upper row terminator and lower row terminator, and the hook is extended and formed at both sides of said H-shape isolator and each notch is configured at the middle position.

3. A receptacle structure according to claim 1, wherein the fixing part extended at the back side of metallic casing is assembled on a base, which is configured with plural contact pads and an insertion slot at each side of the said base, and both sides at the fixing part are bent downward and extended as a side insert arm to be fit and soldered into the insertion slots on the base, and both plural signal pins of upper and lower row terminators are passing through the back lower of metallic case to be soldered with those contact pads on the base.

4. A receptacle structure according to claim 1, wherein the fixing part extended at the back side of metallic casing is assembled on the base, which is configured with plural contact pads and a side mount pad at each side of the said base, both sides at the fixing part are bent downward and then bent again toward the outside to be extended as a side mount pad and soldered on the side mount pad of base, and also both plural signal pins of upper and lower row terminators are passing through the back lower of metallic case to be soldered with those contact pads on the base.

5. A receptacle structure according to claim 1, wherein the upper isolator and lower isolator are formed as a stopper at both front.

6. A receptacle structure according to claim 1, wherein the metallic casing is assembled with a metallic housing, which is configured with an insertion port to fit the outer rim of said metallic casing, and the metallic housing is configured with an upper fitting to have a joint assembly with the upper rib located in the extended fixing part, and at least one spring, extended on top surface of metallic casing, is configured to contact with the inner surface of metallic housing.

7. A receptacle structure according to claim 1, wherein the metallic casing is assembled with a metallic housing, which is configured with an insertion port to fit the outer rim of said metallic casing, and the metallic housing is configured with a strip opening to expose and fit with the upper rib located in the extended fixing part, and at least one spring, extended on top surface of metallic casing, is configured to contact with the inner surface of metallic housing.

8. A receptacle structure according to claim 1, wherein both upper isolator and lower isolator are configured with plural of coupling parts to fit each other reciprocally, both upper isolator and lower isolator are configured with notches and both side frame in the middle and after position are lower than that in the front to form as a rabbet; and both upper isolator and lower isolator are configured with a reciprocal opening which are fit with a cover 25 respectively, and are embedded with a fixing plate respectively which extends to form as plural vertical ribs and pin space for plural signal pins of both upper row terminator and lower row terminator.

9. A receptacle structure according to claim 8, wherein there is an H-shape isolator configured between plural signal pins of upper row terminator and lower row terminator, and the hook is extended and formed at both sides of said H-shape isolator and each notch is configured at the middle position.

* * * * *